US007714487B2

(12) United States Patent
Horikoshi et al.

(10) Patent No.: US 7,714,487 B2
(45) Date of Patent: May 11, 2010

(54) DISCHARGE LAMP, METHOD FOR MANUFACTURING THE DISCHARGE LAMP ELECTRODE, LIGHTING SYSTEM

(75) Inventors: Yoshiichi Horikoshi, Fukushima (JP); Yukio Hara, Fukushima (JP); Masahiro Kikuchi, Tokyo (JP); Hiroshi Takahashi, Fukushima (JP); Ryouichi Yoshida, Fukushima (JP); Hiroto Watanabe, Fukushima (JP)

(73) Assignee: Sony Corporation, Tokyo (JP)

( * ) Notice: Subject to any disclaimer, the term of this patent is extended or adjusted under 35 U.S.C. 154(b) by 359 days.

(21) Appl. No.: 10/586,449

(22) PCT Filed: Jan. 19, 2005

(86) PCT No.: PCT/JP2005/000613

§ 371 (c)(1),
(2), (4) Date: Jun. 4, 2007

(87) PCT Pub. No.: WO2005/069350

PCT Pub. Date: Jul. 28, 2005

(65) Prior Publication Data

US 2007/0228913 A1 Oct. 4, 2007

(30) Foreign Application Priority Data

Jan. 20, 2004 (JP) ..... 2004-011961
Jan. 11, 2005 (JP) ..... 2005-003319

(51) Int. Cl.
*H01J 61/62* (2006.01)
*H01J 61/00* (2006.01)
*H01J 9/00* (2006.01)

(52) U.S. Cl. ..... 313/37; 445/49; 445/48; 445/46; 313/567; 313/578; 313/618; 313/626

(58) Field of Classification Search ..... None
See application file for complete search history.

(56) References Cited

U.S. PATENT DOCUMENTS 4,464,603 A * 8/1984 McVey ..... 313/624
6,809,477 B2 * 10/2004 Soules et al. ..... 313/631
2001/0048269 A1 * 12/2001 Kai et al. ..... 313/113
2003/0232564 A1 12/2003 Mochizuki et al.
2006/0113885 A1 * 6/2006 Iimura ..... 313/485
2006/0214551 A1 * 9/2006 Watanabe et al. ..... 313/318.01
2006/0214581 A1 * 9/2006 Hara ..... 313/567
2008/0157676 A1 * 7/2008 Nagahara et al. ..... 313/631

FOREIGN PATENT DOCUMENTS

DE 103 19 498 A1 12/2003
JP 57-123627 A 8/1982
JP 60-175338 A 9/1985
JP 62-012045 A 1/1987
JP 07-014542 A 1/1995
JP 2003-323847 A 11/2003

OTHER PUBLICATIONS

English translation of JP 07-014542 (Sato).*
English translation of JP 07-0124542 (SATO) from Jan. 17, 1995.*
PCT International Search Report for PCT/JP2005/000613 mailed on May 17, 2005.

* cited by examiner

*Primary Examiner*—Peter J Macchiarolo
*Assistant Examiner*—Natalie K Walford
(74) *Attorney, Agent, or Firm*—Rader, Fishman & Grauer PLLC

(57) ABSTRACT

It is possible to prolong service life of a discharge lamp of hot-cathode type and to reduce a diameter thereof. A discharge lamp 1 is provided with an electrode 3. The electrode 3 has a heater 4 made up a coil portion 4*a*, and a first lead wire portion 4*b* and a second lead wire portion 4*c* that respectively extend from rear ends of this coil portion 4*a* and applied by an electron emission material 3*a*. In the electrode 3, a first lead-in wires 6*a* is connected to the first lead wire portion 4*b* and a second lead-in wires 6*b* is connected to the second lead wire portion 4*c*, so that the coil portion 4*a* is arranged vertically along the tube axis of the glass tube 2. The electrode 3 is also provided a sleeve 7 covering surrounding of the coil portion 4*a* and having openings in the faces respectively opposite to the forward end and rear end of the coil portion 4*a*. An open end 7*a* of the sleeve 7 exceeds a forward end of the coil portion 4*a*, thereby protecting the coil portion 4*a*.

5 Claims, 9 Drawing Sheets

DISCHARGE LAMP, METHOD FOR MANUFACTURING THE DISCHARGE LAMP ELECTRODE, LIGHTING SYSTEM

TECHNICAL FIELD

The present invention relates to a discharge lamp of hot-cathode type, a discharge-lamp electrode, a method for manufacturing the discharge-lamp electrode, and a lighting system. More specifically, it relates to employment of an electrode having a coil portion along a tube axis of a glass tube, thereby reducing a diameter of the glass tube and prolonging a service life of the electrode.

BACKGROUND ART

Conventionally, a discharge lamp has been used that employs a fluorescent substance as a light source. Among the discharge lamps, a discharge lamp of hot-cathode type has been used as a backlight of a liquid crystal display (LCD) as well as for lighting because discharge lamp of this type has a high level of luminous efficiency and hence a high degree of luminance.

The discharge lamp of hot-cathode type has a configuration in which its glass tube is equipped with an electrode at each of its two opposed ends, a rare gas such as argon and mercury are enclosed in an internal space of the glass tube, and a fluorescent substance is coated into an interior of the glass tube.

FIG. 1 is a cross-sectional view of a configuration of a conventional discharge lamp of hot-cathode type. A discharge lamp 51 is equipped with an electrode 53 at each of two opposed ends of its glass tube 52. A rare gas such as argon, and mercury are enclosed in an internal space of the glass tube 52, and a fluorescent substance 52*a* is coated into a predetermined region in an interior of the glass tube 52.

The electrode 53 includes a heater 54 having a coil portion 54*a*. To the heater 54, an electron emission material 53*a* such as barium oxide is applied. The heater 54 is stretched with tension between two lead-in wires 55 inserted through an end of the glass tube 52 and held in position thereby. Therefore, in the electrode 53, the coil portion 54*a* of the heater 54 is arranged sideways so as to be perpendicular to a tube axis of the glass tube 52.

The light emission principle of the discharge lamp 51 of hot-cathode type will be explained as follows: when a voltage is applied between the two electrodes 53 at a high frequency in a condition where, by means of energizing these electrodes 53 the heater 54 heats the electron emission material 53*a*, the electron emission material 53*a* emits electrons to cause to be generated arc discharge between the electrodes 53.

The electrons emitted from the electron emission material 53*a* and then accelerated collide with mercury atoms so as to excite them. The mercury atoms thus excited emit ultraviolet light. This ultraviolet light is converted into visible light by the fluorescent substance 52*a*, thereby reducing the discharge lamp 51 luminiferous.

Conventional discharge lamps of hot-cathode type face a problem such that so-called ion sputtering in which any ions generated during discharge collide with electrodes so as to scatter the electron emission material occurs to a conspicuous degree. In other words, since the coil of the heater that constitutes the electrodes is arranged sideways so as to be perpendicular to the tube axis of the glass tube, the ions collide with a major portion of the coil. Therefore, ion sputtering occurs to a conspicuous degree. If ion sputtering occurs to a conspicuous degree over an entirety of the coil, the electron emission material is exhausted during discharge, and it is thus impossible to carry out any stable arc discharge over a long period of time. This results in a problem of a reduced service life of the electrodes.

Further, since the electrodes are stretched with tension at the heater, a problem has arisen that after use over a long period of time, they tend to become disconnected.

Thus, the electrodes have a short service life, so that another problem arises insofar that the discharge lamp itself has a shortened service life.

Moreover, since the heater extends perpendicularly to the tube axis, a problem has arisen that a diameter of the tube cannot be reduced.

Further, although a discharge lamp of cold-cathode type, which can be reduced in tube diameter, has a longer service life, it suffers from a large drop in voltage of a cathode, thus resulting in poor efficiency.

The present invention solves these problems and has an object to provide a discharge lamp with a short tube diameter, that is of a higher level of efficiency and longer in terms of service life, an electrode for use in the discharge lamp, a method for manufacturing the discharge lamp electrode, and a lighting system.

DISCLOSURE OF THE INVENTION

In order to SOLVE THE ABOVE-MENTIONED PROBLEMs, A DISCHARGE LAMP RELATED TO THE INVENTION HAS an electrode including a heater constituted of a coil portion and a first lead wire portion and a second lead wire portion that respectively connect the coil portion through a rear end of the coil portion, the heater having an electron emission material applied thereto, and scattering-prevention member, which is a cylindrical sleeve shoes both ends are open, for covering surrounding of the coil portion, the both open ends respectively facing the forward end and the rear end of the coil portion, and a connection-reinforcing member that has a first connection member for connecting the first lead wire portion, and a second connection member for connecting the second lead wire portion, while the first and second connection members integrated with each other by means of a coupling portion, each of the first and second connection members being composed of L-shaped plate member, wherein the connection-reinforcing member is supported by any one of the first and second connection members, wherein in the electrode, the first lead wire portion is connected to a first lead-in wire and the second lead wire portion is connected to the second lead-in wire, the first and second lead-in wires being provided on two opposed ends of a glass tube in which a gas containing a light-emitting material is enclosed and to an interior of which fluorescent substance is coated, and wherein the coil portion is arranged parallel to a tube axis of the glass tube.

According to a discharge lamp related to the present invention, by energizing the electrode, an electron emission material is heated to emit electrons, and also by applying a voltage between the two electrodes at a high frequency, arc discharge occurs. The electrons thus accelerated collide with a light-emitting material so as to excite it, and in turn the light-emitting material emits, for example, ultraviolet light. Then, this ultraviolet light collides with a fluorescent substance so as to be converted into visible light, thereby rendering the discharge lamp luminiferous.

Although ions generated during discharge generally collide with the electrodes and thus contribute to scattering of the electron emission material, the ions specifically collide mainly with a forward end of a coil portion of each of the electrodes because the coil portion is arranged parallel to a tube axis of a glass tube. Therefore, the electron emission material is inhibited from being scattered along a major part of the coil portion.

Further according to the discharge lamp relative to the invention, cylindrical scattering-prevention member whose both ends are open that respectively face the forward end and the rear end of the coil portion, covers surrounding of the coil portion.

Thus, according to a discharge lamp related to the present invention, a scattering-prevention member arranged around the coil portion inhibits the ions from colliding with a side of the coil portion and also inhibits the electron emission material from being evaporated.

A method for manufacturing a discharge lamp electrode related to the invention has a winding step of winding a wire to form a heater, the heater having a coil portion and a first lead wire portion and a second lead wire portion that extend respectively from a rear end of the coil portion, a connection-reinforcing-member-welding step of welding the first lead wire portion of the heater to a first connection member of a connection-reinforcing member, and of welding the second lead wire portion of the heater to a second connection member of the connection-reinforcing member, the connection-reinforcing member including the first and second connection members with them being integrated with each other by means of a coupling portion, an application step of applying an electron emission material to the heater in a condition where the heater is held by the connection-reinforcing member, a lead-in portion welding step of welding a first lead-in wire to the first connection member and a second lead-in wire to the second connection member, and a cutting step of cutting off the coupling portion from the connection-reinforcing member to separate the first and second connection members from each other.

According to the method for manufacturing a discharge lamp electrode related to the invention, a first lead wire portion of a heater that is structured by means of the winding of wire is connected to a first connection member of a connection-reinforcing member, and a second lead wire portion of the heater is connected to a second connection member of the connection-reinforcing member. The first connection member and the second connection member are integrated with each other by means of a coupling portion during a manufacturing process and, therefore, have a function to hold a shape of the heater. By performing the application step of the electron emission material and the lead-in portion welding step in a condition where the heater shape is thus held, the heater is prevented from being deformed during the manufacturing process.

A lighting system related to the present invention is equipped with the above-described discharge lamp.

BEST MODE FOR CARRYING OUT THE INVENTION

Embodiments of a discharge lamp, a discharge lamp electrode and a method for manufacturing the discharge lamp electrode, and a lighting system of the present invention will all be described below with reference to drawings.

1. Configuration of Discharge Lamp and Electrode Therefor

Figure 2A:
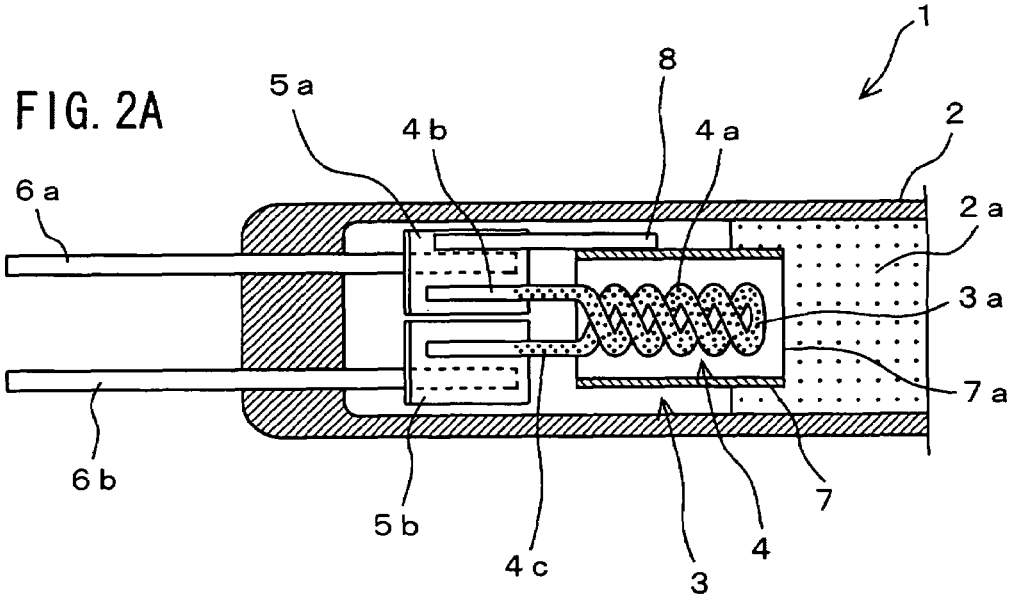
FIG. 2A is a cross-sectional view of important components of a configuration of a discharge lamp of the present embodiment.
Figure 2B:
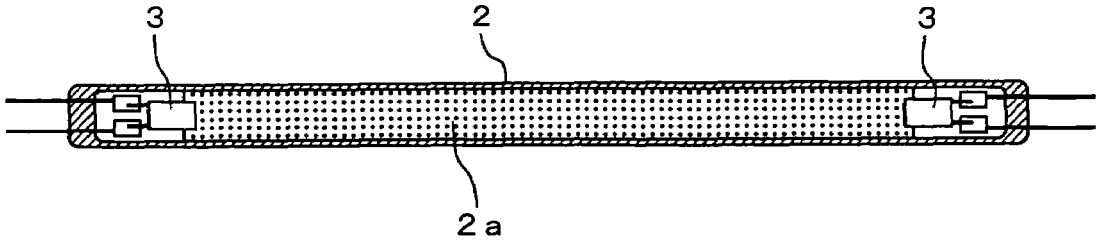
FIG. 2B is another overall cross-sectional view of the configuration of the discharge lamp of the present embodiment.
Figure 3A:
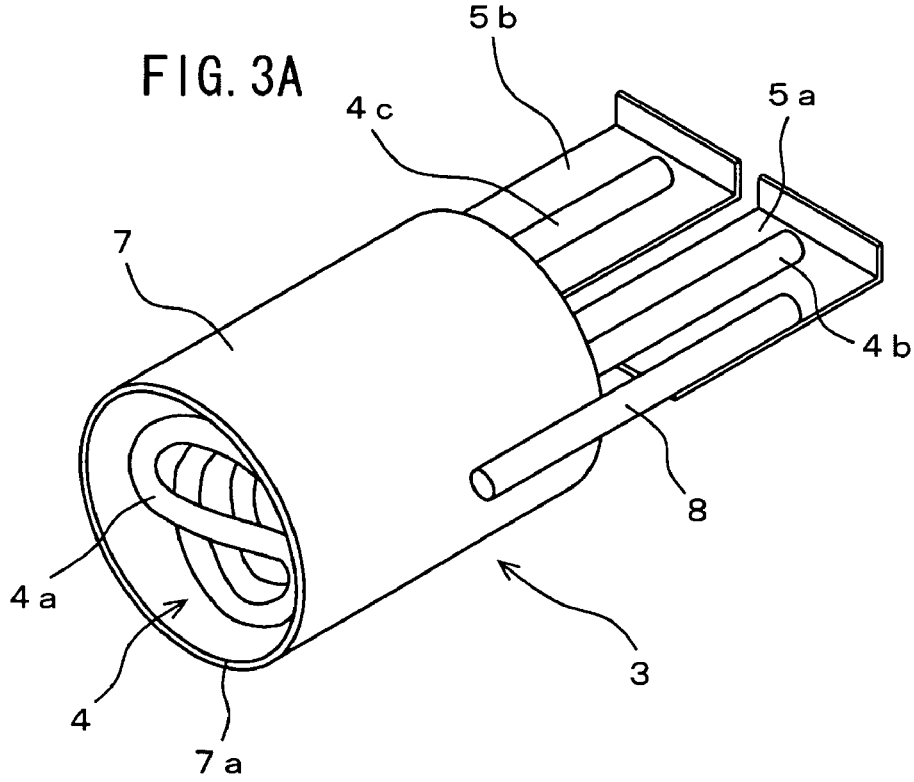
FIG. 3A is a perspective view of a configuration of a discharge lamp electrode of the present embodiment.
Figure 3B:
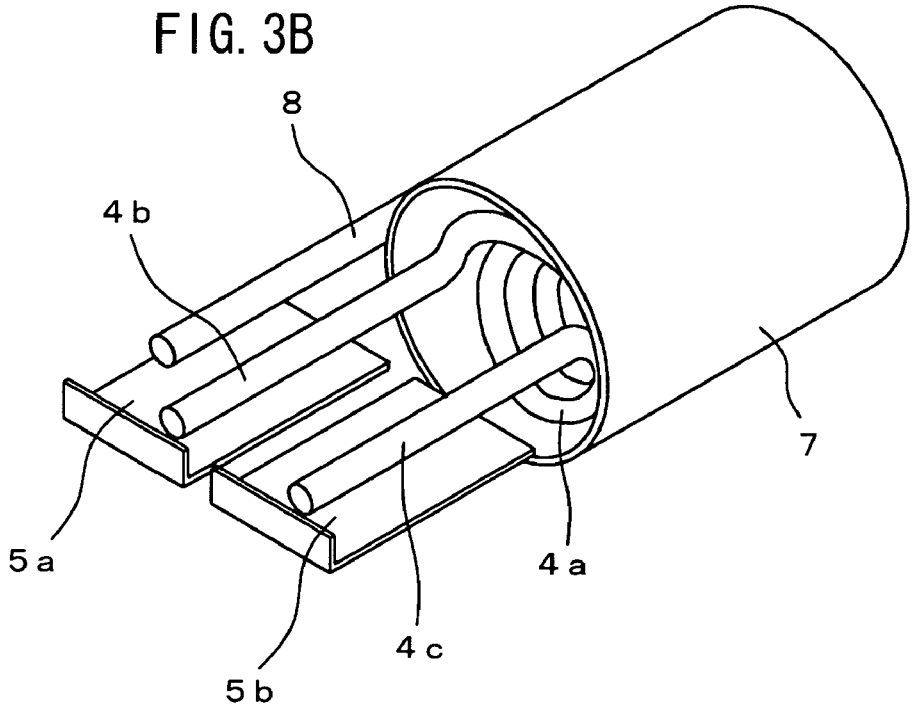
FIG. 3B is another perspective view of the configuration of the discharge lamp electrode of the present embodiment.

FIGS. 2A and 2B are cross-sectional views of a configuration of the discharge lamp of the present embodiment, and FIGS. 3A and 3B are perspective views of a configuration of the discharge lamp electrode of the present embodiment. It should be noted that FIG. 2A is a cross-sectional view of important components of the discharge lamp, an end of which is taken along a plane including an axis of its glass tube, and FIG. 2B is an overall cross-sectional view of the discharge lamp. Further, FIG. 3A is a perspective view of the electrode, as viewed from the side of a forward end thereof, and FIG. 3B is a perspective view of the electrode as viewed from the side of a rear end thereof.

A discharge lamp 1 of the present embodiment is a discharge lamp of hot-cathode type having electrode 3 at two opposed ends of a rod-shaped glass tube 2 with a small diameter. A fluorescent substance 2*a* is coated to a predetermined region of an interior of the glass tube 2. Further, in the inside of the glass tube 2, a rare gas, such as argon (Ar) or neon (Ne), and mercury (Hg), which is a light-emitting material, are enclosed.

The electrode 3 has a heater 4 made up of a coil portion 4*a*, and a first lead wire portion 4*b* and a second lead wire portion 4*c* that respectively extend from this coil portion 4*a*. The heater 4 is constituted of a wire made of a material such as tungsten (W) or tungsten rhenium (Re—W). It should be noted that in the present embodiment, tungsten rhenium is employed because a wire made of tungsten rhenium are superior to those made of tungsten in terms of strength at times when they are being heated.

Figure 4A:
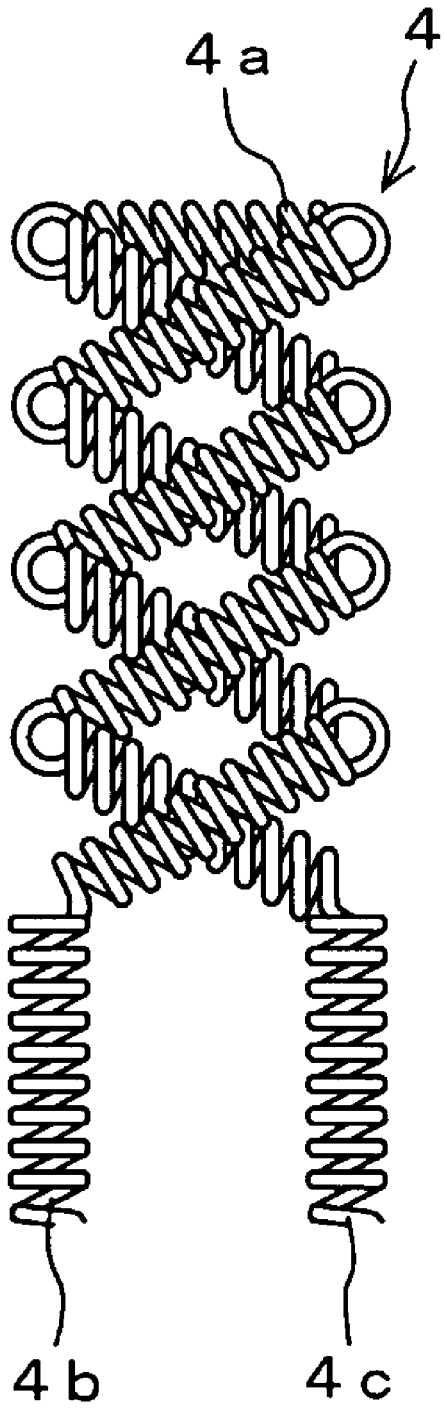
FIG. 4A is an explanatory illustration of a configuration of a heater.
Figure 4B:
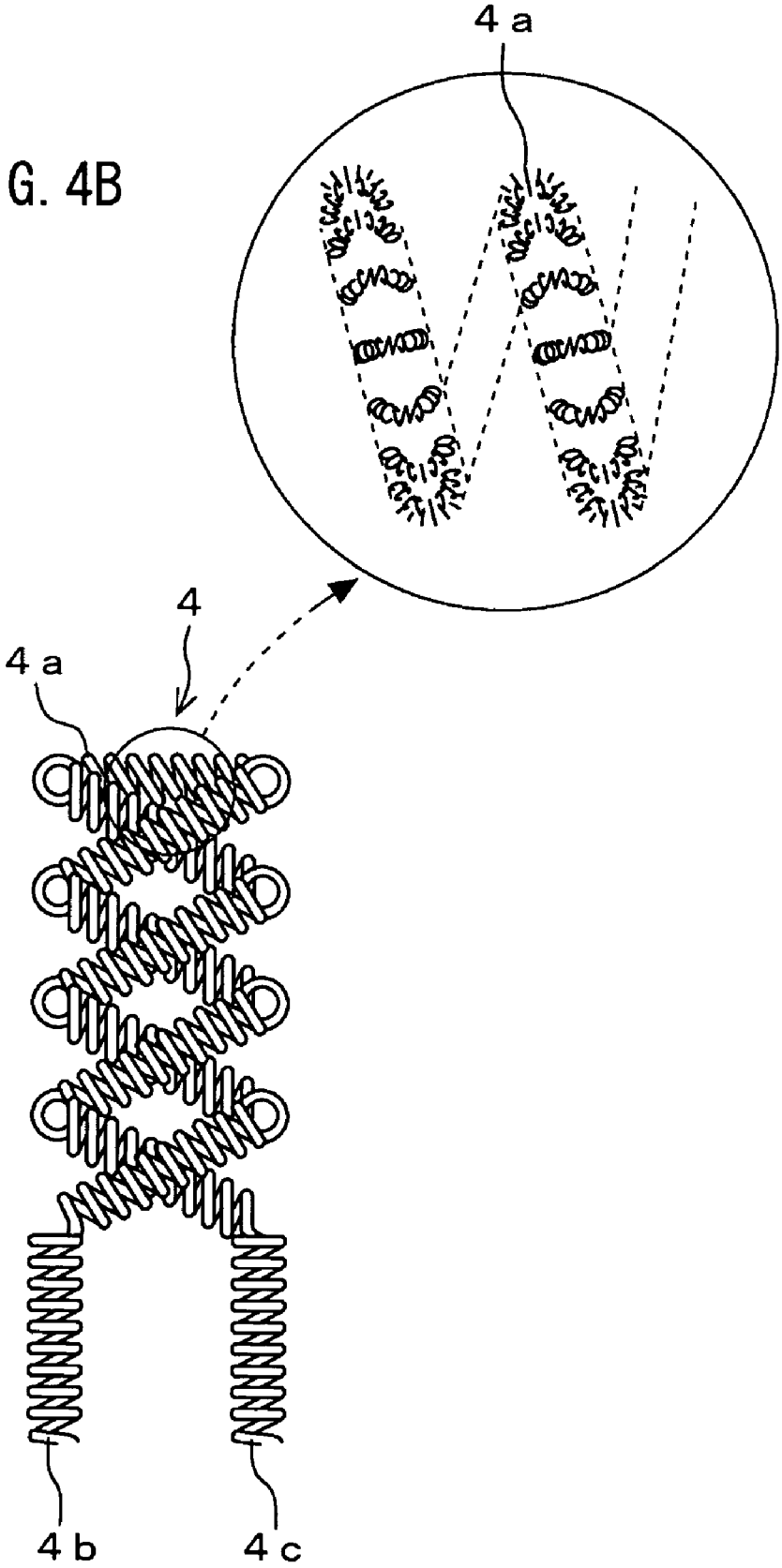
FIG. 4B is an explanatory illustration of another configuration of the heater.
Figure 4C:
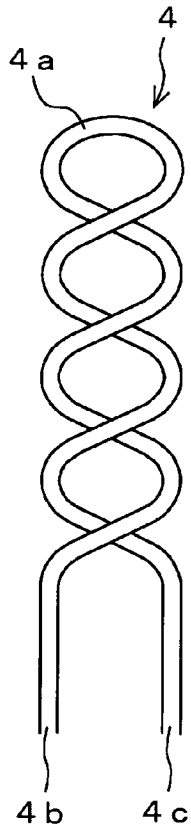
FIG. 4C is an explanatory illustration of a further configuration of a heater.

FIGS. 4A-4C are explanatory illustrations each showing a configuration of the heater 4. According to a method for manufacturing the heater 4, which will be explained later, by spirally winding a wire made of tungsten rhenium etc. and by further winding the wire spirally in such a manner that the wire do not come into contact therewith, a roughly cylindrical coil portion 4*a* having a double spiral structure is formed in such a way that the two lead wire portions 4*b* and 4*c* respectively extend from rear ends of the coil portion 4*a*, as shown in FIG. 4A.

Further, as shown in an enlarged illustration of FIG. 4B, the spirally wound wire may be further wound spirally and, as shown in the overall illustration of FIG. 4B, additionally wound spirally to form a roughly cylindrical coil portion 4*a* having a triple spiral structure in which the two lead wire portions 4*b* and 4*c* extend from the respective rear ends of the coil portion 4*a*.

Thus, a double spiral structure in which spirally wound wire is further wound spirally is referred to as a double helical structure, while a triple spiral structure in which spirally wound wire is further wound spirally and additionally wound spirally is referred to as a triple helical structure.

It should be noted that the heater 4 may have a single helical structure in which the wire is simply wound spirally, as shown in FIG. 4C, as long as one important condition is met, that the coil portion 4*a* be arranged parallel to a tube axis.

Further, the heater 4 is plated with a ternary alkaline earth metal oxide composed of barium (Ba), strontium (Sr), and calcium (Ca). It should be noted that as the electron emission material 3*a*, binary barium oxide may be employed. Alternatively, zirconium oxide may be added to this alkaline earth metal oxide by about 1-5% by weight, and this is widely known as an electron emission material for use in discharge lamps of hot cathode type.

In order to provide a double or triple structure of the heater 4, as shown in FIG. 4A or 4B respectively, a long wire is required to form the coil portion 4*a*. In other words, a surface area of the coil portion 4*a* can be increased. It is thus possible to increase a quantity of the electron emission material to be coated to the coil portion 4*a*, and thereby prolong a service life of the electrode 3.

It should also be noted that a triple spiral structure of the heater 4 results in an increase in diameter of the coil portion 4*a*, so that the heater preferably has a double spiral structure in order to reduce a diameter of the glass tube 2.

It should be noted that although the diameter of wire of the heater 4 is generally 25-70 μm or so, it would be preferable to have a diameter of, for example, 45-55 μm or so, as the diameter that provides both cases of easy winding and good strength if the heater has a double spiral structure.

The electrode 3 has a first heater tab 5*a* and a second heater tab 5*b* that support the heater 4. The first heater tab 5*a* provides a first connection member, to which a rear end of the first lead wire portion 4*b* of the heater 4 is connected by welding. The second heater tab 5*b* provides a second connection member, to which a rear end of the second lead wire portion 4*c* is connected by welding.

The first heater tab 5*a* and the second heater tab 5*b* are made of a plate material such as stainless steel (SUS304) and, as will later be described in the context of the method for manufacturing the electrode 3, during manufacturing of the electrode 3, the first and second heater tabs 5*a* and 5*b* integrally function as a connection-reinforcing member and, during a manufacturing process, are separated from each other.

The electrode 3 is connected to a first lead-in wire 6*a* and a second lead-in wire 6*b*, via respectively the first heater tab 5*a* and the second heater tab 5*b*. The first and second lead-in wires 6*a* and 6*b* are positioned at the opposed ends of the glass tube 2 and enter from the outside through each of the ends of the glass tube 2, roughly in parallel with each other.

Then, to an extension end of the first lead-in wire 6*a* inside the glass tube 2, the first heater tab 5*a* is connected by welding, while to an extension end of the second lead-in wire 6*b* inside the glass tube 2, the second heater tab 5*b* is connected by welding.

The electrode 3 thus supported by the first and second lead-in wires 6*a* and 6*b* is of such a vertical arrangement that the coil portion 4*a* of the heater 4 extends parallel to the tube axis of the glass tube 2. A configuration is thus formed in which ions generated by discharge collide mainly with the forward end of the coil portion 4*a*, and, as a result of colliding with the ions, inhibit scattering of the electron emission material 3*a* at sides of the coil portion 4*a*.

Further, in the electrode 3, the lead-in wires support the heater 4 by the two lead wire portions extending from the side of the rear end of the coil portion 4*a*, so that no tension is applied to the heater 4 and a configuration is achieved in which it becomes difficult for disconnection to occur.

Moreover, in the present embodiment, a sleeve 7 is provided on the electrode 3 so as to prevent the electron emission material 3*a* from scattering and evaporating. The sleeve 7 is one example of a scattering-prevention member, is made of nickel (Ni), molybdenum (Mo) and the like, and has a cylinder shape, both ends of which are open.

The sleeve 7 has the coil portion 4*a* of the heater 4 inserted therein in such a direction as to be roughly in parallel therewith, and is attached to the first heater tab 5*a* by means of a sleeve lead wire 8. Accordingly, the sleeve 7 covers the surrounding of the coil portion 4*a* with both ends facing the forward end and the rear end of the coil portion 4*a* being open.

It should be noted that, like the first and second heater tabs 5*a* and 5*b*, the sleeve lead wire 8 is made of, for example, stainless steel (SUS304). Further, although, in the present embodiment, the sleeve lead wire 8 has been fixed to the first heater tab 5*a*, it may be fixed to the second heater tab 5*b*.

It should also be noted that, in the configuration, an inner diameter of the sleeve 7 is larger than an outer diameter of the coil portion 4*a* so that, when the coil portion 4*a* of the heater 4 is inserted into the sleeve 7 in such a direction as to be roughly in parallel, the coil portion 4*a* does not come into contact with the sleeve 7.

Further, the outer diameter of the sleeve 7 is smaller than an inner diameter of the glass tube 2 so that the sleeve 7 and the glass tube 2 do not come into contact with each other in configuration.

Moreover, the position where the sleeve 7 is attached is set in such a manner that in the positional relationship, the forward end of the coil portion 4*a* does not protrude from an open end face 7*a* of the sleeve 7. It should also be noted that although in positional relationship, the coil portion 4*a* is preferably arranged toward an interior of the sleeve 7 with a forward end of the coil portion 4*a* being not reached to the open end face 7*a* of the sleeve 7, the open end face 7*a* of the sleeve 7 and the forward end of the coil portion 4*a* may also be arranged in an identical plane with each other.

Further, the sleeve 7 is made larger than the coil portion 4*a* is made, so that a shape is formed where the sleeve 7 covers an entirety of the side of the coil portion 4*a*.

It should be noted that the above-described region where the fluorescent substance 2*a* is coated onto an interior of the glass tube 2 is supposed to extend slightly outside the open end face 7*a* of the sleeve 7 of the electrode 3. This region where the fluorescent substance 2 is coated provides a light-emitting section of the discharge lamp 1.

2. Operations of the Discharge Lamp

Next, the operations of the discharge lamp 1 of the present embodiment will be described. First, by applying voltage of, for example, about 5 V across the lead-in wire 6*a*, 6*b* to apply voltage across the lead wire portions 4*b* and 4*c* of the heater 4 constituting each electrode 3, the heater 4 heats the electron emission material 3*a*. Then, voltage of, for example, about 300V is applied across the two electrodes 3 at a high frequency.

Accordingly, electrons are emitted from the electron emission material 3*a* and arc discharge occurs between the electrodes 3. It should be noted that after arc discharge occurs between the electrodes 3, control is conducted in such a way that voltage of, for example, about 100V is applied across the two electrodes 3 and also voltage of, for example, about 2V is applied to each of the electrodes 3. It should be noted that each of the electrodes 3 need not be supplied with voltage but, as described above, in order to prolong service life thereof, they could preferably be supplied with the voltage of around 2V.

The electrons, accelerated after having been emitted from the electron emission material 3*a*, collide with mercury atoms so as to excite them. The mercury atoms thus excited emit ultraviolet light. The fluorescent substance 2*a* converts this ultraviolet light into visible light, so as to render the discharge lamp 1 luminiferous.

Although ions generated during the discharge collide with the electrodes 3 and thus contribute to scattering of the electron emission material 3*a*, the ions specifically collide mainly with the forward end of the coil portion 4*a* because the coil portion 4*a* is arranged parallel to the tube axis of the glass tube 2. Therefore, the electron emission material 3*a* is inhibited from being scattered at most of the side of the coil portion 4*a*.

Further, since the coil portion 4*a* is inserted into the sleeve 7 and the open end face 7*a* of the sleeve 7 protrudes from the forward end of the coil portion 4*a*, collision of the ions with the forward end of the coil portion 4*a* is also inhibited. It is thus possible to inhibit the electron emission material 3*a* from being exhausted over a long period. Therefore, the electron 3 can emit electrons over a long period, thereby prolonging service life.

In addition, the electron emission material 3*a* evaporates as it is being heated by the heater 4. If the sleeve 7 is not provided, the electron emission material 3*a* that has evaporated is deposited on the interior of the glass tube 2. Because the coil portion 4*a* is inserted into the sleeve 7 in this embodiment, the electron emission material 3*a* that has evaporated from the heater 4 is deposited on an interior of the sleeve 7. Then, as the heater 4 heats up, the sleeve 7 is also heated so as also to emit electrons from the electron emission material 3*a* deposited on the sleeve 7. It thus becomes possible to prolong the service life of the electrodes 3.

Thus, the service life of the electrons 3 can be prolonged, so that the service life of the discharge lamp can be prolonged.

Further, since the heater 4 is inserted into the sleeve 7, it is possible to heat the heater at a low voltage to a desired temperature, by thermal radiation. For example, it is possible to lower a voltage to be applied during pre-heating down from, for example, about 5V to, for example, about 3V.

It should be noted that if the coil portion 4*a* is in contact with the sleeve 7, a temperature of the heater 4 is lowered, so that to heat the heater to a desired temperature, a higher voltage needs to be applied. Therefore, as described above, the coil portion 4*a* and the sleeve 7 are configured so as not to come into contact with each other.

In the discharge lamp 1 of the present embodiment, by arranging the coil portion 4*a* of the heater 4 parallel to the tube axis of the glass tube 2, the tube diameter of the glass tube 2 can be reduced, thus matching the diameter of the coil portion 4*a*. Hot-cathode type discharge lamps of the conventional structure have a limit of an outer diameter of about 6.2 mm of the glass tube. In contrast, in the discharge lamp 1 of the present embodiment, the outer diameter of the glass tube 2 can be reduced to about 2-3 mm. Further, by arranging the coil portion 4*a* parallel to the tube axis of the glass tube 2, the coil portion 4*a* can be maintained for long enough to ensure that a sufficient quantity of the electron emission material 3*a* can be applied thereto. Furthermore, by providing, for example, a double spiral structure of the heater 4, an additional quantity of the electron emission material 3*a* can be applied.

As a direct-illumination type backlight of an LCD, a discharge lamp of cold-cathode type with a small diameter has been used in order to thin the display. In contrast to this configuration, the discharge lamp 1 of the present embodiment can reduce the diameter of the glass tube 2 by arranging the coil portion 4*a* vertically. It is thus possible to thin the display even in a case where the discharge lamp 1 of the present embodiment is used as a direct-illumination type backlight of LCDs.

It is known that a discharge lamp of hot-cathode type has a higher level of luminous efficiency than that of a discharge lamp of cold-cathode type. Specifically, the former has twice the degree of the efficiency of the latter and about twice luminance of the latter. Further, it is generally known that a discharge lamp secures a higher degree of luminance as the tube diameter of a glass tube is reduced.

Accordingly, in a case where the discharge lamp 1 of the present embodiment is used as a direct-illumination type backlight of an LCD, the number of about discharge lamps 1 to be used can be decreased to about a half if the same degree of luminance can still be obtained as that in a case where a discharge lamp of cold-cathode type is used.

Further, if ten discharge lamps 1 are used as a direct-illumination type backlight of an LCD, a power of about 33 watts is dissipated. Since power of about 55 watts is dissipated by a backlight that uses the same number of discharge lamps of cold-cathode type having the same size, by use of the discharge lamps 1 of the present embodiment, dissipation power can be reduced by about 40%. In comparison with a discharge lamp of cold-cathode type, it is thus possible both to reduce dissipation power and to improve the luminance.

Further, since the coil portion 4*a* can be maintained for long enough to have a sufficient quantity of electron emission material 3*a* applied thereto, service life can be prolonged even when the diameter of the glass tube 2 is reduced.

Figure 5:
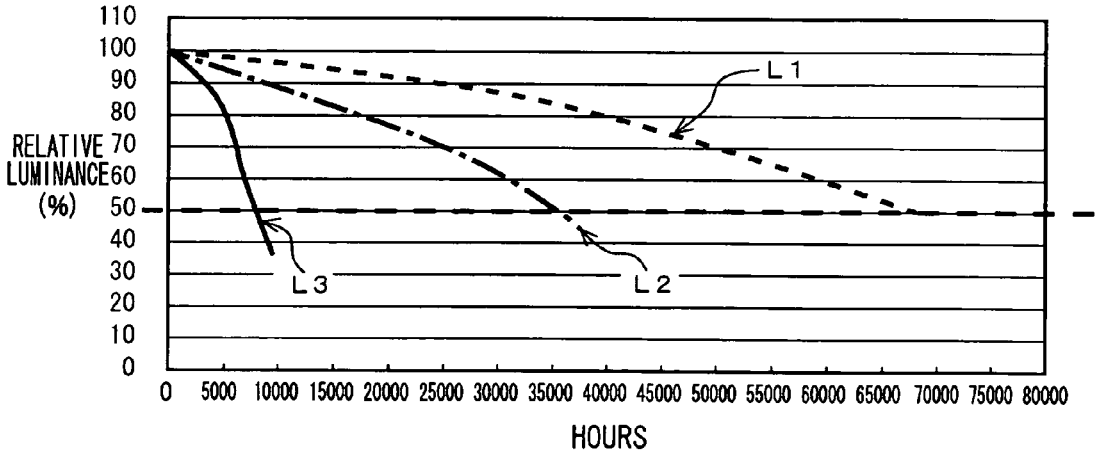
FIG. 5 is a graph comparing a service life of the discharge lamp of the present embodiment and that of the conventional discharge lamp.

FIG. 5 is a graph comparing a service life of the discharge lamp 1 of the present embodiment and that of the conventional discharge lamp. In this, broken line L1 represents changes in the luminance in a case where 2V is applied to each of the electrodes 3, as described above in the discharge lamp 1 of the present embodiment, with reference to FIGS. 2A, 2B, 3A, and 3B. Dash-and-dot line L2, on the other hand, indicates changes in the luminance in a case where no voltage is applied to any of the electrodes 3 in the discharge lamp 1 of the present embodiment. Further, solid line L3 indicates changes in the luminance of a discharge lamp having the conventional structure shown in FIG. 1.

Figure 1:
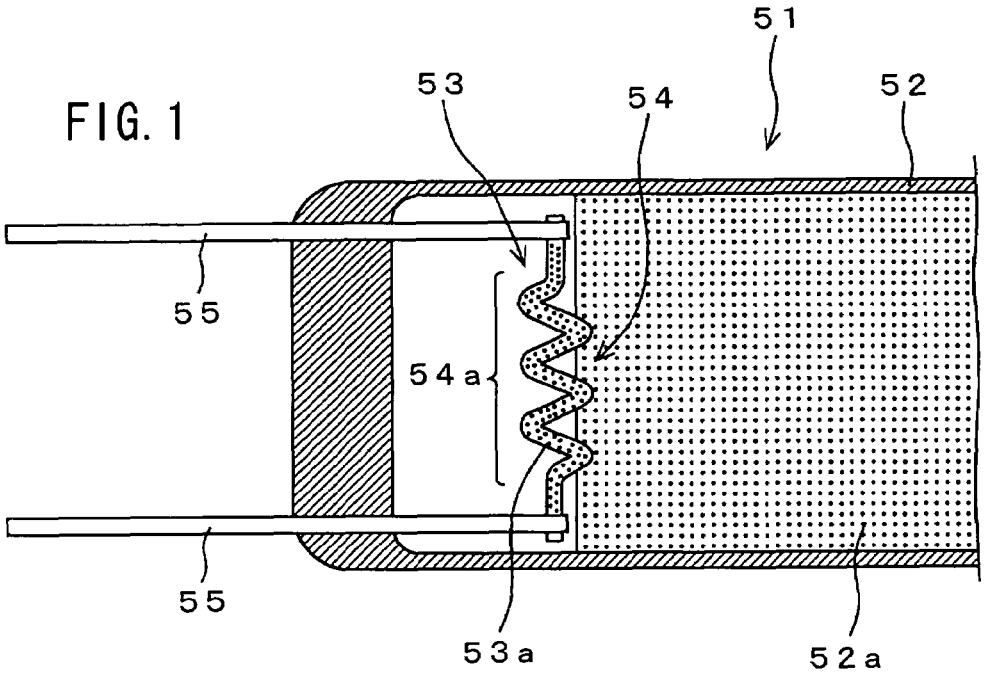
FIG. 1 is a cross-sectional view of a configuration of a conventional discharge lamp of hot-cathode type.

The discharge lamp of the conventional structure shown in FIG. 1 suffers a rapid decrease in the quantity of electron emission material caused by ion sputtering, and when it has been used for about 7000 hours, its degree of luminance drops to about 50% of its original value at the time that it was first used. Further, before 10000 hours have elapsed, the electron emission material is used up, and the electrode is disconnected.

In contrast, in the discharge lamp 1 of the present embodiment described with reference to FIGS. 2A, 2B, 3A, and 3B, ion sputtering does not readily occur and a sufficient quantity of electron emission material 3*a* can be applied to the heater 4, irrespective of the tube diameter of the glass tube 2. Relative luminance can thus be kept at 50% or higher for about 35000 hours, if no voltage is applied to the electrodes 3, and relative luminance can still be kept at 50% or higher, if voltage of about 2V is applied to each of the electrodes, without exhaustion of the electron emission material 3*a* even in cases where it has been used in excess of 60000 hours.

Further, no tension is applied to the heater 4, and inhibition of ion sputtering does not accompany any disconnection of the heater 4. From the above, it has been found that the discharge lamp 1 of the present embodiment can enjoy a service life five to ten times longer than that of the conventional discharge lamp.

3. Method for Manufacturing Electrodes

As described above, in the case of the electrode 3 according to the present embodiment, the coil portion 4*a* of the heater 4 is arranged parallel to the tube axis of the glass tube 2, thus resulting in a configuration in which the lead-in wires support the heater 4 by two lead wire portions extending from the rear end of the coil portion 4*a*.

Therefore, no tension is applied to the heater 4, and the task remains of keeping a shape of the heater 4 during manufacturing of the electrodes 3. By connecting the lead wire portion and the lead-in wire to each other via the heater tabs so that the heater tabs work as a connection-reinforcing member, the shape of the heater 4 can be kept.

FIGS. 6A-6H are process drawings showing one example of the method for manufacturing a discharge lamp electrode of the present embodiment, and the following will describe the method for manufacturing the electrode 3 by utilizing the heater tabs.

(1) Winding Step

Figure 6A:
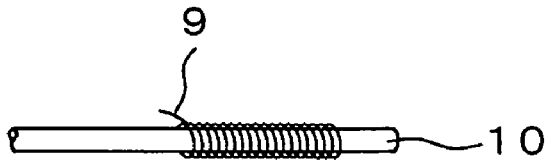
FIG. 6A is a process drawing of an example of a manufacturing method for a discharge lamp electrode of the present embodiment.
Figure 6B:
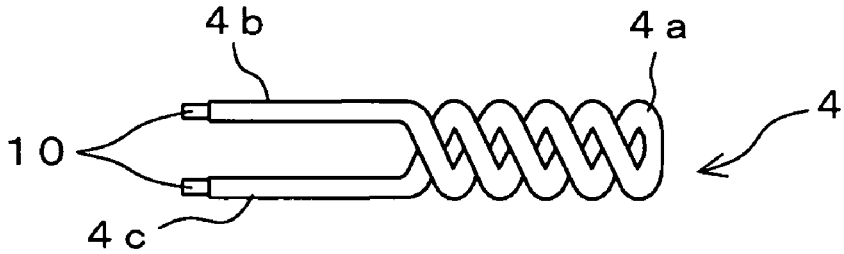
FIG. 6B is another process drawing of the example of the manufacturing method for the discharge lamp electrode of the present embodiment.
Figure 6C:
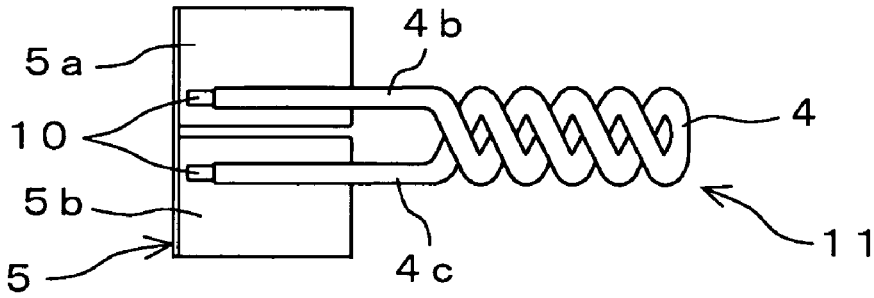
FIG. 6C is a further process drawing of the example of the manufacturing method for the discharge lamp electrode of the present embodiment.

In the winding step, first as a first winding step, as shown in FIG. 6A, a wire 9 made of, for example, tungsten rhenium is spirally wound around a core wire 10 made of molybdenum. Next, as a second winding step, as shown in FIG. 6B, the core wire 10 around which the wire rod 9 has been wound is wound in a double spiral configuration so as to form a roughly cylindrical coil portion 4*a* in such a manner that the two lead wire portions 4*b* and 4*c* extend from the rear ends of the coil portion 4*a*.

It should be noted that the coil portion 4*a* has a form such that the adjacent wire 9 do not come in contact therewith. By this winding step, a heater 4 can be made whose shape is maintained by the core wire 10. This winding step may include a step of removing distortion in the wire 9 by utilizing thermal treatment.

(2) Heater-Tab-Welding Step

Figure 7:
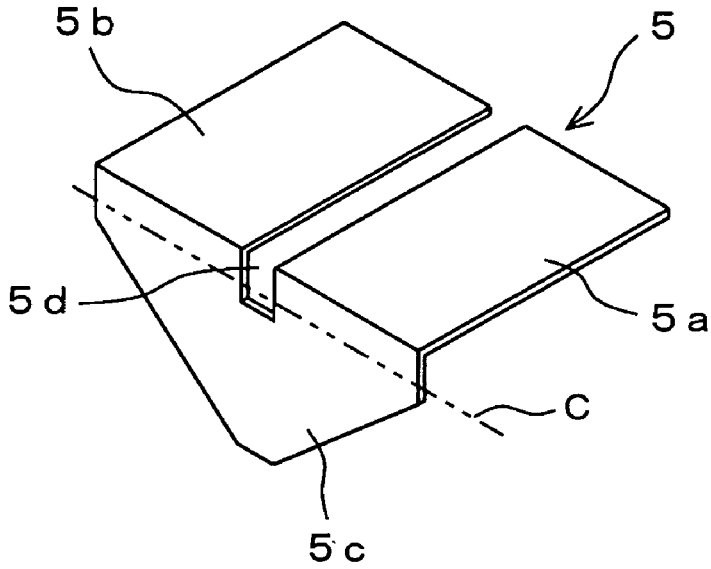
FIG. 7 is a perspective view of a configuration of a heater tab.

In the heater-tab-welding step, the heater 4 is welded to the heater tabs. FIG. 7 is a perspective view of a configuration of the heater tabs. The heater tabs 5, which work as a connection-reinforcing member, has a first heater tab 5*a* and a second heater tab 5*b*, as already described above.

The first and second heater tabs 5*a* and 5*b* are each L-shape in cross section and integrated with each other at a coupling portion 5*c* where shorter sides of L-shape of these heater tabs 5*a* and 5*b* are thus coupled with each other.

Further, between the first and second heater tabs 5*a* and 5*b*, a separation groove 5*d* is formed. The separation groove 5*d* extends to the coupling portion 5*c*, so as to make it easy to separate the first and second heater tabs 5*a* and 5*b* from each other when the coupling portion 5*c* is cut off, which will be described later.

Referring back to FIGS. 6A-6I, in the heater-tab-welding step, as shown in FIG. 6C, to the first heater tab 5*a* of the integral heater tab 5, the rear end of the first lead wire portion 4*b* of the heater 4 is welded. Further, to the second heater tab 5*b*, the rear end of the second lead wire portion 4*c* of the heater 4 is welded. Thus, a heater assembly 11 is manufactured in which the heater 4 and the heater tab 5 are integrated with each other. This heater-tab-welding step does not encounter any loss of shape because the shape is maintained by the core wire 10.

(3) Dissolving Step

Figure 6D:
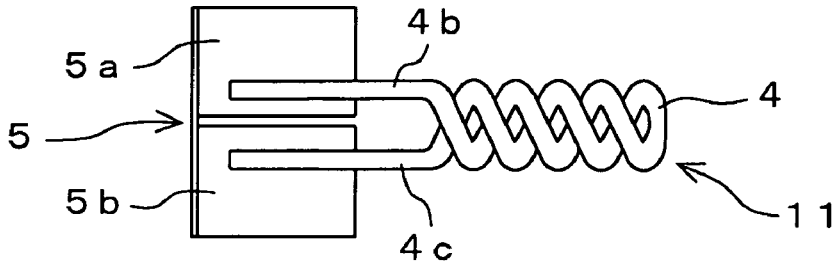
FIG. 6D is a still further process drawing of the example of the manufacturing method for the discharge lamp electrode of the present embodiment.

In the dissolving step, as shown in FIG. 6D, a core wire 10 made of molybdenum, around which the wire 9 made of tungsten rhenium has been wound, is dissolved. For example, by dipping the heater assembly 11 into a mixed acid solution of sulfuric acid and nitric acid, a core wire 10 made of molybdenum can be dissolved. It should be noted that tungsten—rhenium and stainless steel are not dissolved in the mixed acid solution, so that the heater 4 and the heater tab 5 remain as they are.

Although the heater 4 gets weaker in strength against external force as the molybdenum-made core wire 10 is dissolved, the heater assembly 11 as a whole retains sufficient strength during operations without losing its shape because the heater 4 is supported by the heater tab 5 in which the first lead wire portion 4*b* and the second lead wire portion 4*c* are integrated with each other.

(4) Application Step

Figure 6E:
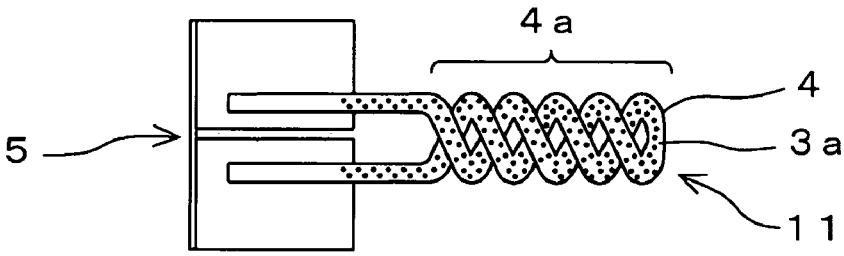
FIG. 6E is an additional process drawing of the example of the manufacturing method for the discharge lamp electrode of the present embodiment.

In the application step, as shown in FIG. 6E, the electron emission material 3*s* is applied to the heater 4. In the present embodiment, ternary barium oxide of (Ba, Sr, Ca)CO3 is applied to the heater 4. The electron emission material 3*a* is applied by, for example, the spray method. By means of the spray method, for example, the electron emission material 3*a* is sprayed onto the heater 4 as the heater assembly 11 is revolved, and the electron emission material 3*a* can be applied even onto an inner side of the coil portion 4*a* at a uniform density.

Further, the electron emission material 3*a* may be applied by the dip method. That is, by dipping the heater 4 of the heater assembly 11 into a tab in which the electron emission material 3*a* is poured, the electron emission material 3*a* can be applied to the coil portion 4*a*.

It should be noted that the oxide (Ba, Sr, Ca)CO3 applied to the heater 4 changes to (Ba, Sr, Ca)O through heating during the manufacturing process. Also, preferably the electron emission material 3*a* applied to the coil portion 4*a* may have a film thickness of about 30-60 μm.

(5) Sleeve-Welding Step

Figure 6F:
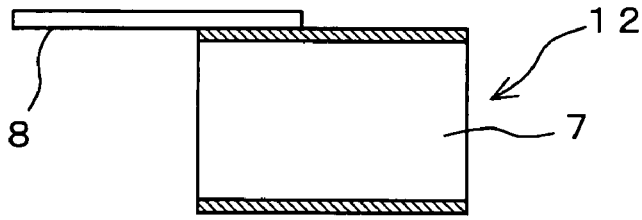
FIG. 6F is an additional process drawing of the example of the manufacturing method for the discharge lamp electrode of the present embodiment.

In the sleeve-welding step, first, as shown in FIG. 6F, the sleeve lead wire 8 is welded to the sleeve 7. Accordingly, a sleeve assembly 12 is manufactured in which the sleeve 7 and the sleeve lead wire 8 are integrated with each other. This step may include a step of conducting heat treatment on this sleeve assembly 12 so as to remove contamination and distortion from it.

Figure 6G:
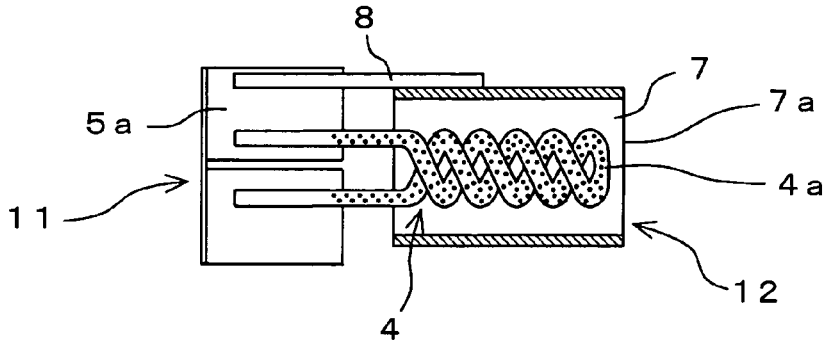
FIG. 6G is an additional process drawing of the example of the manufacturing method for the discharge lamp electrode of the present embodiment.

Next, as shown in FIG. 6G, the heater assembly 11, as a finished off application of the electron emission material 3*a*, and the sleeve assembly 12 are connected to each other. First, the coil portion 4*a* of the heater 4 is inserted into the sleeve 7. In this case, they are aligned with each other in such a manner that the side of the coil portion 4*a* does not come into contact with the inner surface of the sleeve 7 with the sleeve lead wire 8 being aligned with the first heater tab 5*a*.

Further, the heater assembly 11 and the sleeve assembly 12 can be aligned with each other in such a manner that the coil portion 4*a* is arranged toward an interior of the sleeve 7 with a forward end of the coil portion 4*a* being not reached to the open end face 7*a* of the sleeve 7. Then, the sleeve lead wire 8 is connected to the first heater tab 5*a* by welding. With this, the heater assembly 11 and the sleeve assembly 12 are integrated with each other.

(6) Lead-in-Wire-Welding Step

Figure 6H:
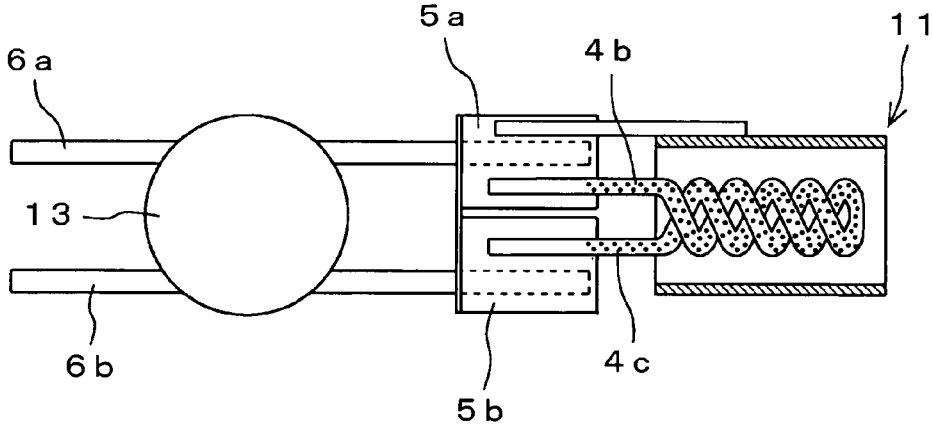
FIG. 6H is an additional process drawing of the example of the manufacturing method for the discharge lamp electrode of the present embodiment.

In the lead-in-wire-welding step, as shown in FIG. 6H, the heater assembly 11, as finished off up to attachment of the sleeve assembly 12, is connected to the first lead-in wire 6*a* and the second lead-in wire 6*b*.

First, the first and second lead-in wires 6*a* and 6*b* have been integrated with each other by means of a stem glass 13. It should be noted that the first and second lead-in wires 6*a* and 6*b* are supported by the stem glass 13 roughly in parallel with each other, with a predetermined spacing left between them so that they do not come into contact with each other.

In this condition, the first lead-in wire 6*a* and the first heater tab 5*a* are connected to each other by welding, while the second lead-in wire 6*b* and the second heater tab 5*b* are connected to each other by welding.

In this case, if a spacing between the first and second lead wire portions 4*b* and 4*c* of the heater 4 is different from a spacing between the first and second lead-in wires 6*a* and 6*b* supported by the stem glass 13, a bending step is required to connect directly the lead wire portion and the lead-in wire.

To cope with this, the lead wire portion and the lead-in wire are connected to each other via the first and second heater tabs 5*a* and 5*b*, thereby rendering inessential a bending step. Further, by welding the lead wire portion and the lead-in wire to the plate-shaped heater tab, they can easily be aligned with each other. In addition, connection strength is enhanced.

(7) Cutting Step

In the cutting step, the coupling portion 5*c* of the heater tab 5 is cut off by laser etc. Since the heater tab 5 has a separation groove 5*d* formed between the first and second heater tabs 5*a* and 5*b*, when the coupling portion 5*c* is cut off at a cut-off position C indicated by a dash-and-two-dots line in FIG. 7, the first and second heater tabs 5*a* and 5*b* have a gap between them and are thus independent of each other in electrical terms.

Figure 6I:
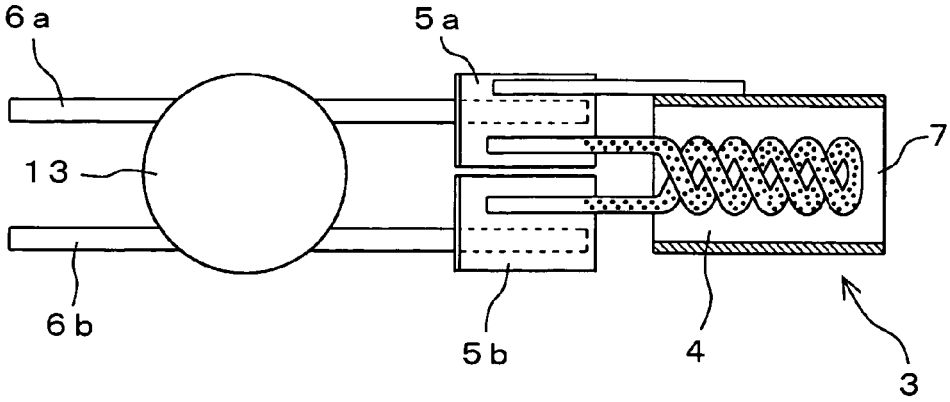
FIG. 6I is an additional process drawing of the example of the manufacturing method for a discharge lamp electrode of the present embodiment.

With the above steps, the electrode 3 is completed as shown in FIG. 6I. It should be noted that during a period between the above-described application step and the lead-in-wire-welding step, the heater 4 is supported by a heater tab 5 in which the first and second heater tabs 5*a* and 5*b* are integrated with each other. Therefore, the shape of the heater 4 is not lost.

At a stage where the first and second heater tabs 5*a* and 5*b* are separated from each other in the cutting step, the heater 4 is also supported by the first and second lead-in wires 6*a* and 6*b* that are supported by the step glass 13 and, again, its shape is not lost.

By thus manufacturing the electrode 3 in such a way that the shape of the heater is supported by the heat tab 5, the heater 4 can be prevented from becoming deformed during the manufacturing process. Accordingly, a yield is improved, thus making it possible to manufacture at a low cost an electrode 3 having a heater 4 in which the coil portion 4*a* is arranged parallel to the tube axis of the glass tube 2.

It should be noted that by reserving an L-shape of the first and second heater tabs 5*a* and 5*b* even after the coupling portion 5*c* has been cut off, strength can be increased.

Accordingly, the first and second heater tabs 5*a* and 5*b* function as a reinforcing member as a product that is to be possibly used in addition to a function as a reinforcing member during the manufacturing process.

Figure 8:
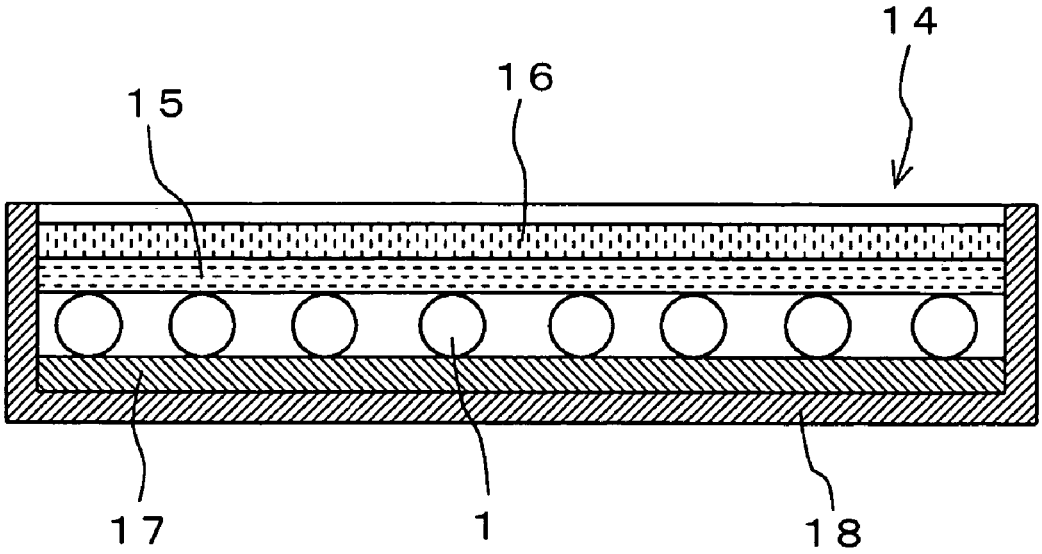
FIG. 8 is an outlined cross-sectional view of a configuration of a lighting system of the present embodiment.

FIG. 8 is an outlined cross-sectional view of a configuration of a lighting system of the present embodiment.

The lighting system 14 of the present embodiment has the discharge lamp 1 described with reference to FIGS. 2A, 2B, 3A, and 3B, a diffusion plate 15, a luminance upgrade sheet 16, a reflection sheet 17, a chassis 18 and the like.

In the lighting system 14, for example, over an entire surface of a bottom of the chassis 18, the reflection sheet 17 for reflecting light is arranged, on which a plurality of discharge lamps 1 is arranged, for example, in parallel with each other.

Further, the diffusion plate 15 which diffuses light radiated by the discharge lamps 1 so as to provide a uniform quantity of light is arranged on the discharge lamps 1, and on the plate 15, the luminance upgrade sheet 16 is arranged which upgrades the luminance of light emitted by the diffusion plate 15.

In this configuration, when the discharge lamps 1 turns luminiferous, direct light from the discharge lamps 1 and reflected light by the reflection sheet 17 enter the diffusion plate 15 and are diffused therein, thus providing a roughly uniform luminance over an entire light-emitting surface of the lighting system 14. This light luminance is upgraded by the luminance upgrade sheet 16, so that the lighting system 14 gives surface illumination.

As described with reference to FIGS. 2A, 2B, etc., the discharge lamp 1 of the present embodiment has the coil portion 4*a* of the heater 4 arranged parallel to the tube axis of the glass tube 2 so that the coil portion 4*a* can be maintained for long enough to have a sufficient quantity of the electron emission material 3*a* applied thereto. A service life of the system can thus be prolonged even when the diameter of the glass tube 2 is reduced.

It is thus possible to realize a thin lighting system 14 having a long service life by utilizing the discharge lamp 1 of the present embodiment.

In a discharge lamp related to the present invention, the coil portion of the heater to which an electron emission material is applied has an electrode arranged vertically along a tube axis of a glass tube. In the electrode related to the present invention, ions generated during discharge collide mainly with a forward end of the coil portion, so that it is possible to inhibit ion sputtering along a major part of a side of the coil portion.

Accordingly, the electron emission material is inhibited from being exhausted and thus can emit electrons over a long period. Further, since the present embodiment applies no tension on the heater by stretch, the heater can be inhibited from being disconnected. Therefore, a service life of the electrode can be prolonged. A prolonged service life of the electrode in turn prolongs a service life of the discharge lamp.

Further, since the electrode is arranged parallel to the tube axis of the glass tube, a tube diameter of the glass tube can be reduced without reducing a length of the coil portion.

Because the coil portion can be maintained for long enough to have a sufficient quantity of an electron emission material applied thereto, a reduced diameter of the glass tube makes it possible to enhance the luminance as well as prolong the length of service life.

Further, a discharge-lamp related to the present invention can further suppress ion sputtering by further arranging a scattering-prevention member around a coil portion. It is also possible to prevent an electron emission material that has evaporated from being scattered onto a tube surface or a fluorescent substance and, further, to prevent the electron emission material from being exhausted. Accordingly, a discharge lamp using an electrode in which a scattering-prevention member is arranged around a coil portion can have a further prolonged service life. Further, the first and second connection members that connect the lead wire portion connected with the coil portion with the lead-in wire provided on the glass tube are made of L-shape plate members, thereby enhancing their strength as the reinforcing members.

According to a method for manufacturing a discharge lamp electrode related to the present invention, for example, a step is performed in which an electron emission material is applied in a condition where a heater is supported by a connection-reinforcing member, so that the heater can be prevented from being deformed during manufacturing process.

As a result, a yield is improved, and it is thus possible to manufacture inexpensively an electrode equipped with a heater in which a coil portion is arranged parallel to a tube axis of a glass tube.

A lighting system related to the present invention can be equipped with the above-described discharge lamp, thereby having a reduced thickness and a prolonged service life.

INDUSTRIAL APPLICABILITY

The present invention relates to a discharge lamp having a longer service life and a smaller tube diameter, and thus can be suitably applied as not only lighting equipment but also a backlight for an LCD, etc., thereby contributing to an improvement in efficiency, prolonging a service life, and reducing a thickness of the LCD.

The invention claimed is:

1. A discharge lamp comprising:

an electrode including:

a heater constituted of a coil portion and a first lead wire portion and a second lead wire portion that respectively connect the coil portion through a rear end of the coil portion, the heater having an electron emission material applied thereto; and scattering-prevention member, which is a cylindrical sleeve whose both ends are open, for covering surrounding of the coil portion, said both open ends respectively facing the forward end and the rear end of the coil portion;

a sleeve lead wire, which is attached to said scattering prevention member at one end and to said heater at the other end; and a connection-reinforcing member that has a first connection member for connecting the first lead wire portion, and a second connection member for connecting the second lead wire portion, while the first and second connection members integrated with each other by means of a coupling portion are separated from each other by cutting the coupling portion, each of the first and second connection members being composed of L-shaped plate member, wherein the connection-reinforcing member is supported by any one of the first and second connection members;

wherein in the electrode, the first lead wire portion is connected to a first lead-in wire and the second lead wire portion is connected to a second lead-in wire, said first and second lead-in wires being provided on two opposed ends of a glass tube in which a gas containing a light-emitting material is enclosed and to an interior of which fluorescent substance is coated;

wherein the coil portion is arranged vertically along a tube axis of the glass tube; and wherein the coil portion is structured by a spiral wire with it being further wound spirally and without coming into contact therewith.

2. The discharge lamp according to claim 1, wherein in the electrode, a forward end of the coil portion is arranged toward an interior of the sleeve without it exceeding an open end face of the sleeve at the forward end side thereof.

3. A lighting system using the discharge lamp according to claim 1.

4. A method for manufacturing a discharge lamp electrode, the method comprising:

a winding step of winding a wire to form a heater, said heater having a coil portion and a first lead wire portion and a second lead wire portion that extend respectively from a rear end of the coil portion;

a connection-reinforcing-member-welding step of welding the first lead wire portion of the heater to a first connection member of a connection-reinforcing member, and of welding the second lead wire portion of the heater to a second connection member of the connection-reinforcing member, said connection-reinforcing member including the first and second connection members with them being integrated with each other by means of a coupling portion;

an application step of applying an electron emission material to the heater in a condition where the heater is held by the connection-reinforcing member;

a sleeve welding step of welding a sleeve lead wire to any one of the first and second connection members and inserting the heater into the inside of a scattering-prevention member, which is a cylindrical sleeve;

a lead-in portion welding step of welding a first lead-in wire to the first connection member and a second lead-in wire to the second connection member; and a cutting step of cutting off the coupling portion from the connection-reinforcing member to separate the first and second connection members from each other.

5. The method for manufacturing the discharge lamp electrode according to claim 4, wherein the winding step comprises:

a first winding sub-step of winding a wire around a core wire; and a second winding sub-step of spirally winding the wire that have been wound around the core wire without come into contact therewith; and wherein a dissolving step of dissolving the core wire is performed after the connection-reinforcing-member-welding step.

* * * * *